US010526836B2

(12) United States Patent
Isaacs

(10) Patent No.: US 10,526,836 B2
(45) Date of Patent: Jan. 7, 2020

(54) ADHESIVE-ATTACHED WINDOW GLAZING ASSEMBLY, MULTI-GLAZED WINDOW ASSEMBLY AND METHOD THEREFOR

(71) Applicant: Mark Isaacs, Bay St. Louis, MS (US)

(72) Inventor: Mark Isaacs, Bay St. Louis, MS (US)

(73) Assignee: GS RESEARCH LLC, Bay St. Louis, MS (US)

( * ) Notice: Subject to any disclaimer, the term of this patent is extended or adjusted under 35 U.S.C. 154(b) by 0 days.

(21) Appl. No.: 15/418,953

(22) Filed: Jan. 30, 2017

(65) Prior Publication Data

US 2018/0216396 A1 Aug. 2, 2018

(51) Int. Cl.

| | |
|---|---|
| ***E06B 3/663*** | (2006.01) |
| ***E06B 3/66*** | (2006.01) |
| ***E06B 7/02*** | (2006.01) |
| ***E06B 3/28*** | (2006.01) |
| ***E06B 3/56*** | (2006.01) |

(52) U.S. Cl.

CPC ..... *E06B 3/66366* (2013.01); *E06B 3/28* (2013.01); *E06B 3/56* (2013.01); *E06B 3/66* (2013.01); *E06B 3/663* (2013.01); *E06B 3/66304* (2013.01); *E06B 2007/026* (2013.01)

(58) Field of Classification Search

CPC ..... E06B 3/663; E06B 3/66; E06B 3/6621; E06B 3/66304; E06B 3/66366; E06B 2007/026

See application file for complete search history.

(56) References Cited

U.S. PATENT DOCUMENTS

| | | | | |
|---|---|---|---|---|
| 3,553,913 | A * | 1/1971 | Eisenberg | E06B 3/6621 52/172 |
| 3,868,805 | A | 3/1975 | Battersby | |
| 4,074,480 | A | 2/1978 | Burton | |
| 4,194,331 | A | 3/1980 | Gingle et al. | |
| 4,459,789 | A | 7/1984 | Ford | |
| 4,494,342 | A | 1/1985 | Decker | |
| 4,604,840 | A | 8/1986 | Mondon | |

(Continued)

OTHER PUBLICATIONS

PCT International Search Report, for Patent Cooperation Treaty (PCT) Application No. PCT/US2018/015739 filed Jan. 29, 2018, dated Apr. 6, 2018.

(Continued)

*Primary Examiner* — Andrew J Triggs

(74) *Attorney, Agent, or Firm* — Hanrahan Law Firm, P.A.; Benjamin M. Hanrahan

(57) ABSTRACT

A window glazing assembly that can convert an existing or already-installed window, or be used to assemble new construction windows as a multi-pane or multi-glazed window unit, is provided herein. In particular, the glazing assembly includes an attachment assembly (e.g., peel-and-stick double-sided adhesive tape) and one or more glazing layers. Some embodiments further include a spacer assembly comprising a plurality of spacer bars that may be individually installed, e.g., one by one, around the perimeter of the window such as, to the window sash, window frame, or glass window pane, itself. The glazing layer(s) can then be secured or adhered to the spacer assembly, for example, around the perimeter thereof. Some embodiments may include additional or intermediate glazing layers, providing additional insulating airspaces and enhanced performance.

6 Claims, 15 Drawing Sheets

(56) References Cited

U.S. PATENT DOCUMENTS

| | | | | |
|---|---|---|---|---|
| 4,699,842 | A | 10/1987 | Jorgensen et al. | |
| 4,873,803 | A | 10/1989 | Rundo | |
| 5,007,217 | A | 4/1991 | Glover et al. | |
| 5,531,047 | A * | 7/1996 | Leopold | B29C 47/30 52/172 |
| 5,836,119 | A | 11/1998 | Emmanuel | |
| 6,108,999 | A * | 8/2000 | Smith | E06B 3/66 52/786.1 |
| 6,289,641 | B1 | 9/2001 | McCandless | |
| 6,339,909 | B1 | 1/2002 | Brunnhofer et al. | |
| 7,347,909 | B2 | 3/2008 | Reichert | |
| 7,743,584 | B2 | 6/2010 | Reichert et al. | |
| 8,112,860 | B2 * | 2/2012 | Collins | E06B 3/677 29/402.01 |
| 8,375,657 | B2 * | 2/2013 | Buchwald | E06B 3/66 428/34 |
| 9,598,858 | B2 * | 3/2017 | Ogden | E04B 1/803 |
| 2002/0046545 | A1 * | 4/2002 | France | E06B 3/24 52/786.1 |
| 2003/0074859 | A1 | 4/2003 | Reichert et al. | |
| 2004/0076815 | A1 | 4/2004 | Reichert | |
| 2004/0209019 | A1 | 10/2004 | Demars et al. | |
| 2005/0132558 | A1 * | 6/2005 | Hennessy | E06B 3/677 29/525 |
| 2005/0144863 | A1 * | 7/2005 | Collins | E06B 3/677 52/204.5 |
| 2006/0286317 | A1 | 12/2006 | Berkowitz | |
| 2008/0066399 | A1 | 3/2008 | Akdag et al. | |
| 2009/0233020 | A1 | 9/2009 | O'Shaughnessy et al. | |
| 2009/0241466 | A1 | 10/2009 | Gussakovsky | |
| 2012/0137608 | A1 | 6/2012 | Plant et al. | |
| 2012/0141699 | A1 * | 6/2012 | Mader | E06B 3/66366 428/34 |
| 2012/0222669 | A1 | 9/2012 | Sellier et al. | |
| 2014/0109499 | A1 * | 4/2014 | Nieminen | E06B 3/66366 52/204.593 |
| 2014/0230351 | A1 | 8/2014 | Andres | |
| 2015/0233173 | A1 | 8/2015 | Ferri et al. | |
| 2016/0168902 | A1 * | 6/2016 | Clarahan | E06B 3/66366 52/172 |
| 2016/0298938 | A1 | 10/2016 | Trott | |

OTHER PUBLICATIONS

Written Opinion of the International Searching Authority, for Patent Cooperation Treaty (PCT) Application No. PCT/US2018/015739 filed Jan. 29, 2018, dated Apr. 6, 2018.

* cited by examiner (Example Window Unit)

ADHESIVE-ATTACHED WINDOW GLAZING ASSEMBLY, MULTI-GLAZED WINDOW ASSEMBLY AND METHOD THEREFOR

FIELD OF THE INVENTION

The present invention is generally directed to a window glazing assembly and a method of installing a window glazing assembly to either an already-installed window unit or as a new construction window unit. The glazing assembly is adapted to provide one or more insulated airspaces to the window unit thereby to increase the thermal insulating capabilities of the window. Retrofits offer an easy-to-install do-it-yourself (DIY) application. New construction or replacement windows of the present invention offer the capacity for double, triple, quadruple or more thermal performance than existing windows.

BACKGROUND OF THE INVENTION

Many window units, e.g., windows in homes, buildings and/or commercial storefronts, lose or dissipate heat at an astounding rate. For instance, it is estimated that nearly $28 billion in annual energy used is wasted in that it, quite literally, goes out the window. This is true even though many windows, and in particular modern windows include double or multiple panes. Adding insulating airspaces to the inside of the window unit or outside of the window unit can help maintain heat or keep heat in (when needed, for example in winter or cold climates) and restrict heat or keep heat out (when needed, for example in warmer or summer climates). While there are some assemblies that can be used to create insulating airspaces on windows, such assemblies are often quite complicated to install or are difficult to ensure a quality, airtight fit. In addition, some of the current solutions interfere with window operability, meaning that once installed, the additional components added to the window unit oftentimes interfere with or even prevent the window from being opened in the intended manner.

As a consequence, there is a need in the art for a window glazing assembly that is easy to install in retrofit and new construction applications that can provide a simple way to convert a single or multiple glazed window unit into a further glazed window unit, providing additional window glazing layers and insulating airspaces. It would also be beneficial if the window unit would maintain its original operability, i.e., opening and closing of the window unit is not impeded or substantially impeded by the glazing assembly.

Further advantages of the proposed glazing assembly include a simple DIY installation. High and affordable performance is desirable, for example, providing insulation with an R-value in the range of R-6 to R-14 or better. In this manner, the R-value of a window unit with the proposed glazing assembly installed may be better than some opaque walls.

SUMMARY OF THE INVENTION

The present invention of at least one embodiment is generally directed to a window glazing assembly that can convert an existing or already-installed window to a multi-pane or multi-glazed window unit, providing enhanced insulation capabilities. Other embodiments may include a multi-glazed window assembly for use in new construction or replacement windows.

In particular, the glazing assembly and/or multi-glazed window assembly of at least one embodiment may include an attachment assembly and one or more glazing panels or layers. The attachment assembly may be in the form of a peel-and-stick double sided tape that allows easy attachment of the glazing panel(s) or layer(s) to a selected portion of the window unit, including, but not limited to the window sash or glass window pane, itself. Some embodiments further include a spacer assembly comprising a plurality of spacer bars that may be individually or separately installed, e.g., one by one, around the perimeter of the window (again, to the window sash or glass window pane, itself). The added glazing layer(s) can then be secured or adhered to the spacer assembly, for example, around the perimeter of the glazing layer(s). Some embodiments may include additional or intermediate glazing layers, providing additional insulating airspaces and enhanced performance.

Typical existing single pane wood sashes often have a depth of about 0.5 inches to 1 inch between the sash face and the glass window pane. Applying a clear, double-sided tape or other attachment assembly to the perimeter of the window sash, and then a clear acrylic glazing layer to the tape creates an insulating airspace which can cut single pane thermal loss and gain in half.

Desiccant faced tape or other like drying agents or substances can be exposed to the inside of the created or insulated airspace in order to control condensation, fogging and/or moisture therein. An additional insulating airspace can be created using a spacer assembly (e.g., ⅝×⅝ PVC trim) that can be supplied cut-to-measure for easy peel-and-stick application around the perimeter of the sash, glass or other portion(s) of the window unit. The glazing layer can then be applied to the spacer assembly to create the insulating airspace. It should be noted that the glazing layer(s) can include a sheet of transparent or translucent acrylic, although other embodiments may use other materials, such as glass, etc. As provided herein, the glazing layer(s) can be tinted, e.g., with a window tint film, to provide additional heat resistance or shielding. In further embodiments, the glazing layer(s) may be hurricane wind/impact resistant in order to meet certain building code and other requirements and regulations.

It should also be noted that the present invention may also be applied to new construction or replacement window units.

Furthermore, a thick or wide spacer assembly (e.g., ⅝ inch×1.5 inch PVC trim) may be used or attached to inner or outer glazing layers with one or more intermediate glazing layers within the same spacer assembly or frame. This creates further insulating airspaces (e.g. three) when two glazing layers are spaced 0.5 inches apart. When applied to a window unit, the multi-glazing assembly creates even more enhanced insulating capabilities (e.g., with an R-value of R-6 or better).

In new construction, the inner and outer glazing layers or panels may act as structural diaphragms between the spacer assembly to create a stress-skin panel capable of resisting structural loads. The load-bearing capacity is aided by the additional structural diaphragm created by the intermediate glazing layers through their attachment to the perimeter of the spacer assembly, which effectively acts as both the sash and frame for the window unit. These multi-layered clear-skinned structural diaphragms avoid the use of headers and potentially carry floor or roof loads without added structure. The diaphragms further add to structural lateral resistance as a sheer panel when connected to other structural elements.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 2:
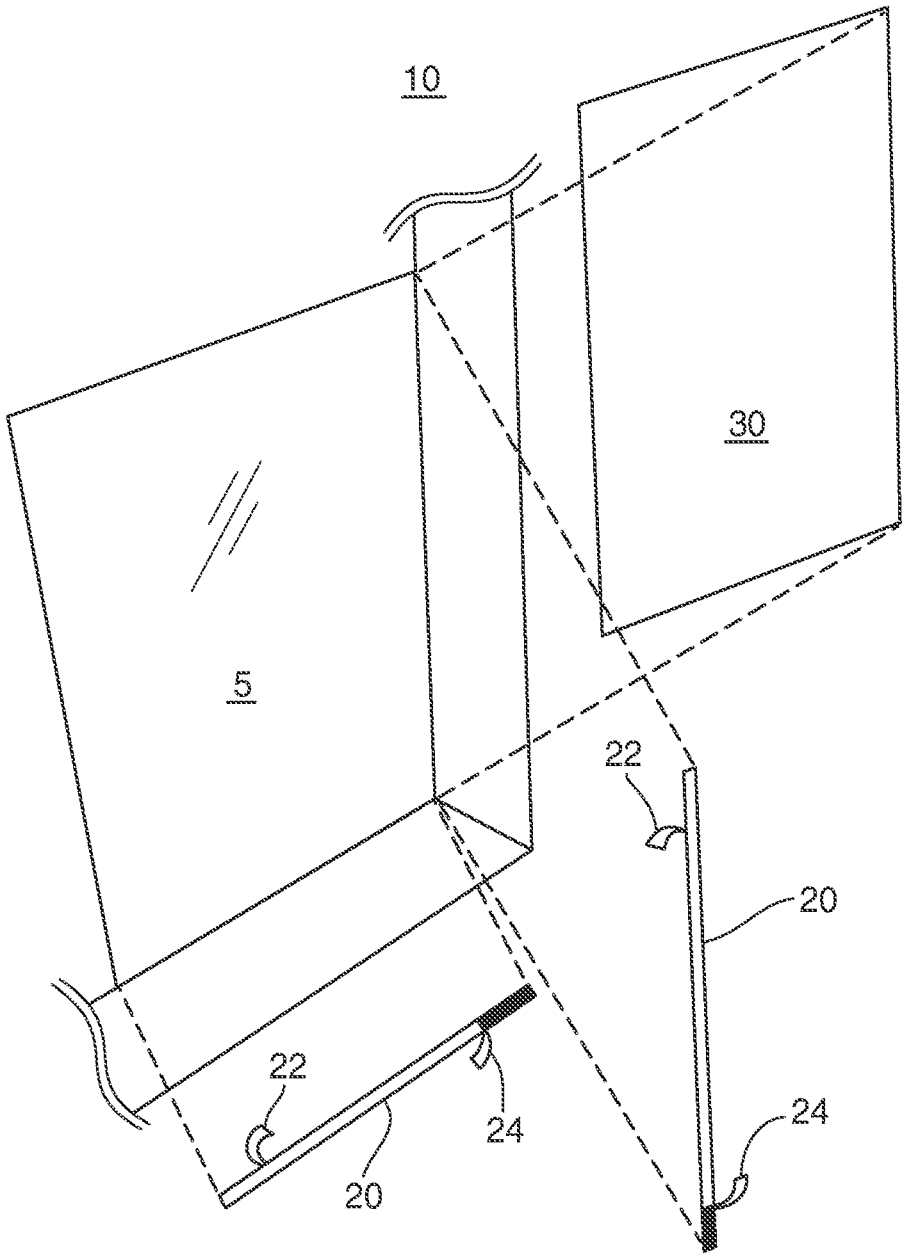
FIG. 2 is a partial cut-away and exploded view of the glazing assembly as disclosed in accordance with at least one embodiment of the present invention.

As shown in the accompanying drawings, at least one embodiment of the present invention is directed to a window glazing assembly, as generally referenced as 10, for example, in FIG. 2. Other embodiments include a multi-glazed window assembly 80 (e.g, as shown in FIGS. 9-12, and a method of installing a window glazing assembly, as generally referenced as 100 in FIG. 15. In particular, the window glazing assembly 10 of at least one embodiment of the present invention comprises a retrofit assembly that can be easily applied or installed to existing or already-installed window units 1. However, it is contemplated that some embodiments of the present invention, and in particular, the multi-glazed window assembly 80 and method 100 can be applied as new construction or as a replacement window.

In any event, the window glazing assembly 10 and multi-glazed window assembly 80 of certain embodiments of the present invention are structured to provide or otherwise create a dead airspace, for example, between the window glazing assembly 10 and the existing window pane(s) 5 of a window unit 1, or between inner and outer glazing layers, to increase or provide enhanced insulation on the window unit 1. For example, certain embodiments of the present invention can be used to reduce thermal loss (e.g. in cold climates) and/or reduce thermal gain (e.g., in warm climates).

Figure 1:
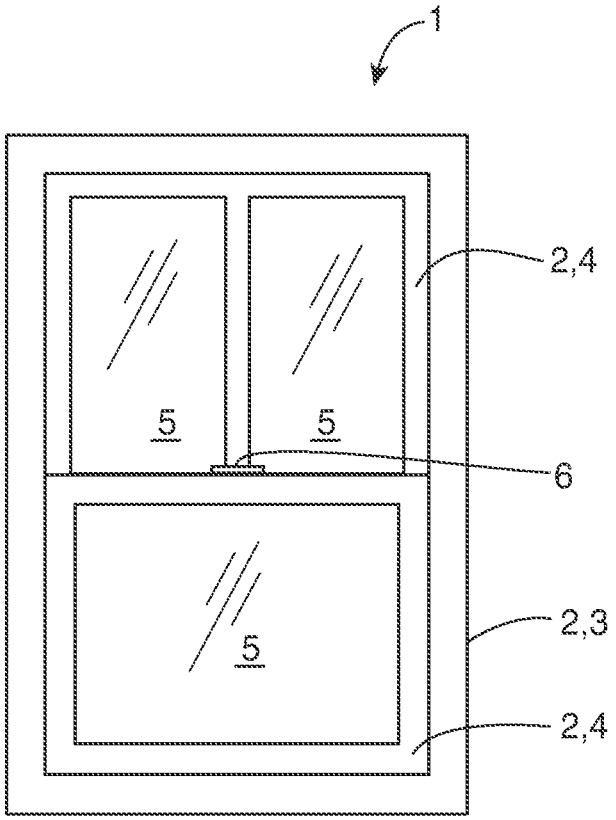
FIG. 1 is an elevation view of the inside of an exemplary window unit.

For instance, with reference to the exemplary window unit 1 represented in FIG. 1, a window unit 1 may include a frame assembly 2 and one or more window panes 5. The window frame 2 may include an outer frame unit, generally represented as 3, and a window sash, generally represented as 4. Particularly, the outer frame unit 3 of the window unit 1 may include the framework that surrounds the entire window unit 1, and may include, for example, the window head unit, jamb, sill, etc. The head unit is generally the main horizontal part of the top of the window frame, the sill is the main horizontal part of the bottom of the window frame, and the jamb are the main vertical parts forming the sides of the window frame 2. The window sash 4 is generally considered the inner portions of the frame 2 that hold or at least partially retain the window pane(s) 5. Specifically, the window sash 4 often holds or retains the glass portion of the window unit 1 and is made up of horizontal and vertical frame units. Oftentimes, depending on the specific construction of the window unit 1, the sash 4 may move, for example, up and down, in and out, side-to-side, etc. in order to open and close the window. With reference to the example shown in FIG. 1, a sash lock 6 locks and unlocks the bottom sash 4, allowing the bottom sash 4 to move up and down, thereby opening and closing the window unit 1. Of course, there any numerous other window units 1 with different constructions, layouts, moving parts, non-moving parts, etc. that can be used in accordance with the various embodiments of the present invention, and it should be understood that the example window unit 1 shown in FIG. 1 is for illustrative or exemplary purposes only.

With reference now to the perspective, exploded and cut-away illustration of FIG. 2, at least a portion of the window glazing assembly 10 of at least one embodiment is shown. Specifically, the window glazing assembly 10 may include an attachment assembly 20 and one or more glazing panels or layers 30. For instance, the attachment assembly 20 is structured and/or adapted to easily attach the glazing layer(s) 30 to the window unit 1, for example, in an overlying or covering relation thereto. In some embodiments, and as shown in FIG. 2, for example, the attachment assembly may include one or more strips or portions of an adhesive tape that can be applied to the window unit 1, and upon which the glazing layer(s) 30 can also be attached or adhered. In this manner, the attachment assembly 20, and in particular, the adhesive tape of at least one embodiment may include a peel-and-stick type of tape with double-sided adhesive surfaces to enable easy application or attachment to the window unit 1 (e.g., to the window sash and/or glass panes) and to the glazing layers 30.

For example, still referring to FIG. 2, the attachment assembly 20, and in particular the attachment tape may include a peel-and-stick double-sided strip of tape such that a layer 22, 24 may be peeled off of one or both sides of the tape to reveal the adhesive surface thereof. One of the adhesive surfaces may be adhered to the window unit 1, for example, at or around the sash 4, whereas the other adhesive surface can be adhered to the inside of the glazing layer 30.

Figure 3:
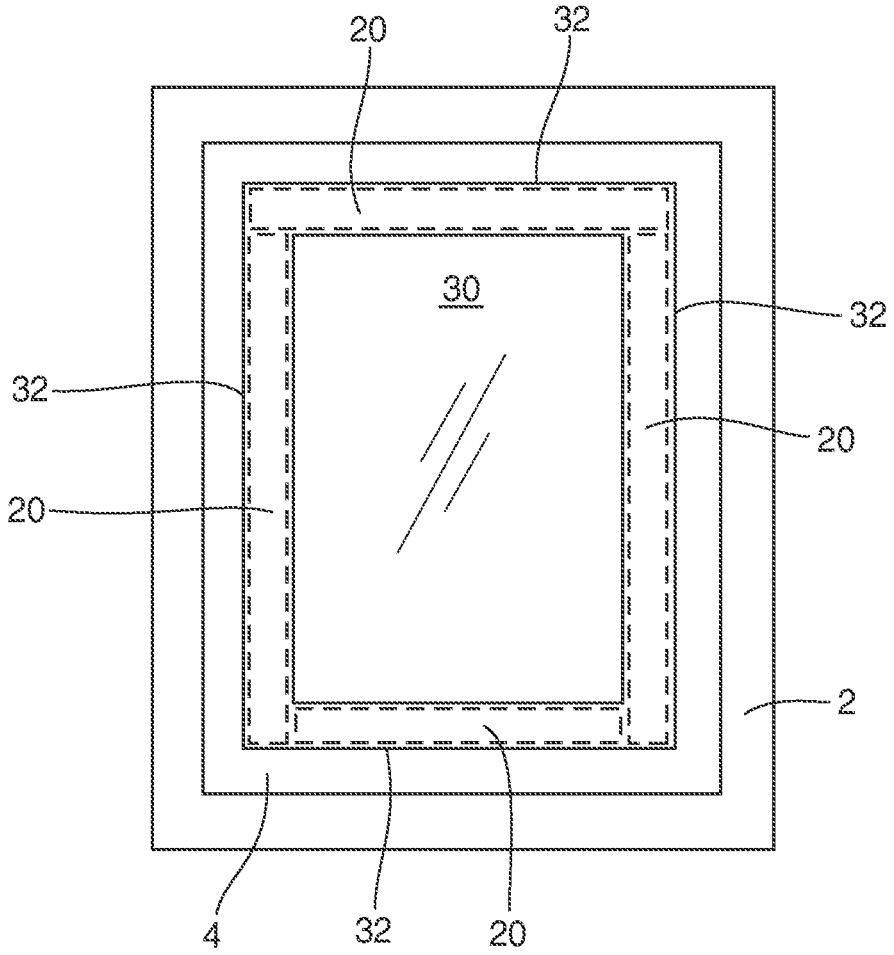
FIG. 3 is an elevation view of a window unit with the glazing assembly of at least one embodiment installed thereon.

Particularly, the attachment assembly, e.g., the peel-and-stick adhesive strips of one embodiment, may be adhered to a portion of the window unit 1, for example, either around the sash 4, another portion of the window frame 2, and/or in some cases, the window pane(s) itself (particularly in commercial, storefront applications). The strips or attachment assembly 20 may be attached to create a substantially continuous perimeter or otherwise be secured to the window unit 1 in a substantially continuous, end-to-end manner, as generally represented in FIG. 3, for example. For instance, in the embodiment where the attachment assembly 20 includes a plurality of strips of adhesive tape, the strips can be secured or adhered one by one in an end-to-end or substantially continuous manner in order to create a substantially continuous seal around the perimeter of the glazing layer 30. This can restrict any unwanted moisture, air, etc. from entering the space between the glazing layer(s) 30 and the existing window pane 5.

Figure 4:
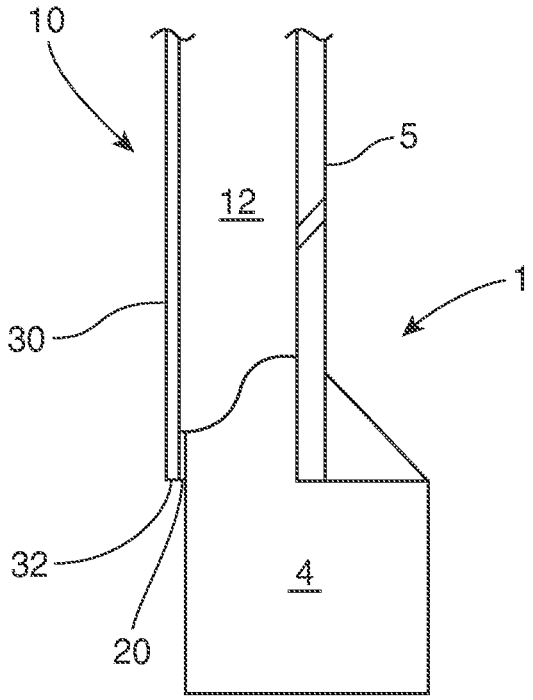
FIG. 4 is a side cut-away view of a window unit with the glazing assembly of at least one embodiment installed on one side thereof.

Furthermore, as shown in FIGS. 3 and 4, for example, the attachment assembly 20, and in particular, the peel-and-stick double-sided adhesive tape of at least one embodiment may be secured at, near or proximate an outer perimeter edge 32 of the glazing layer 30. In this regard, the outer perimeter edge 32 of the glazing layer 30 may be adhered or secured to the window unit 1 via the attachment assembly 20 of at least one embodiment providing a perimeter and edge seal substantially continuously around the glazing layer 30.

With reference now to FIG. 4, a side or cut-away/sectional view is shown with the window glazing assembly 10 installed on one side of a window unit 1. It should be noted that the assembly 10 can be installed on either or both sides, e.g., the inside and/or the outside, of the window unit 1. Particularly, in some applications, the glazing assembly 10 may be installed outside, for example, on an upper portion of a window unit 1, where the lower portion of the window unit 1 slides or moves up in order to open/close the window. This allows the assembly 10 to be installed while maintaining window operability, i.e., maintaining the ability to open/close the window as designed. Other applications (e.g., inside, outside, or both) may differ depending on the style, size and shape of the particular window unit 1.

In any event, still referring to FIG. 4, the assembly 10 creates an airspace, such as an insulated dead airspace 12 between the window pane 5 and the glazing layer 30. The airspace 12 may be approximately ¼ of an inch to ¾ of an inch thick (measured from the window pane 5 to the glazing layer 30), although other sizes and dimensions are contemplated within the full spirit and scope of the present invention. In the embodiment shown in FIG. 4, the attachment assembly is secured to the window sash 4 and the glazing layer 30 is secured or adhered thereto. It should be noted that additional glazing layer(s) 30 may be layered or secured to the inside or outside of the window unit 1 creating additional layered and separated insulated airspaces 12.

Figure 5:
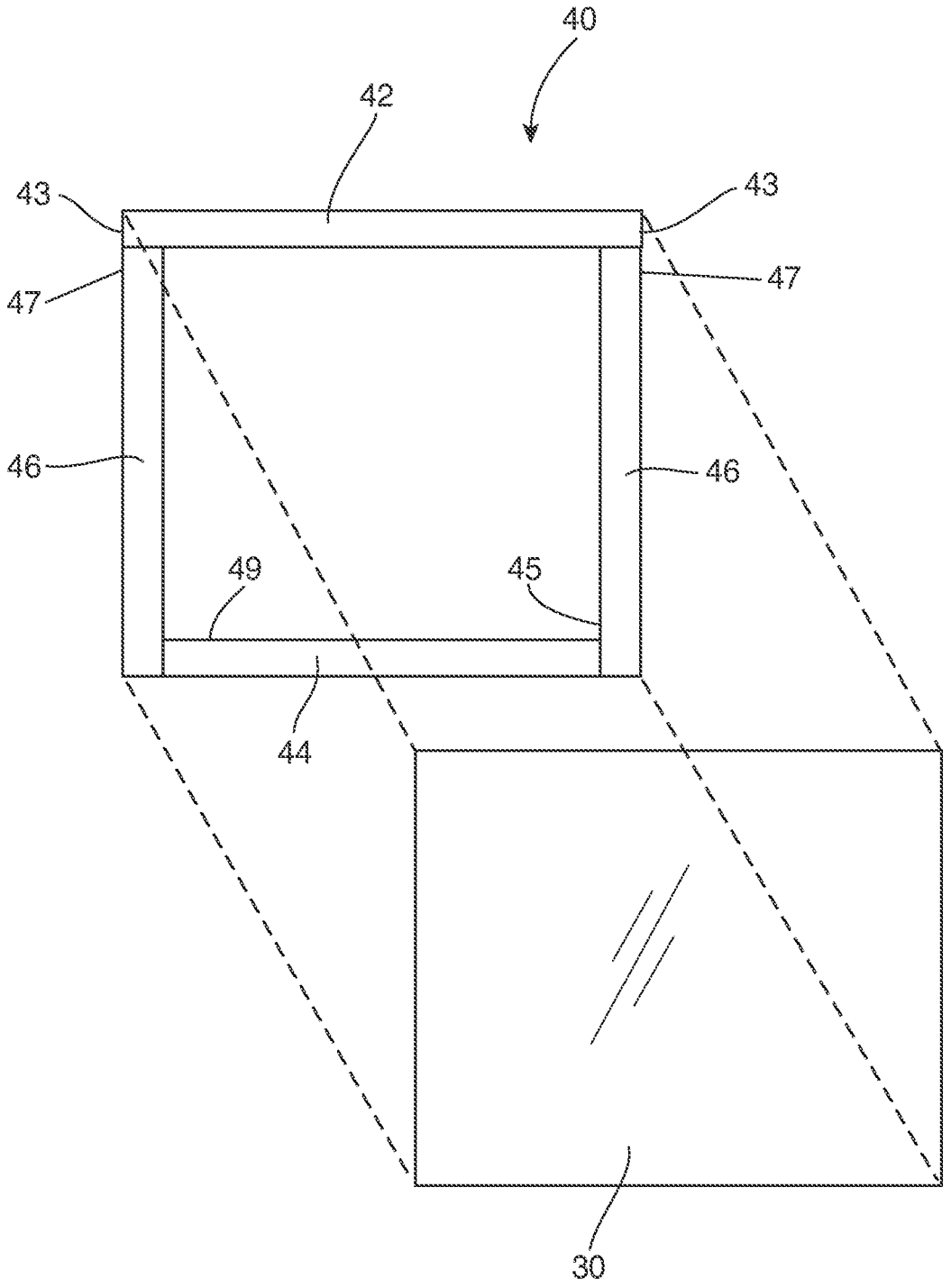
FIG. 5 is an exploded view illustrating the spacer assembly and glazing panel as disclosed in accordance with yet another embodiment of the present invention.

In yet another embodiment, as shown in FIG. 5, the assembly 10 of at least one embodiment includes at least one spacer assembly 40 comprising a plurality of spacer bars 42, 44, 26. The spacer assembly 40 is adapted to secure or adhere to the window unit 1, wherein the glazing layer(s) 30 is secured or adhered to the spacer assembly 40. This spaces the glazing layer(s) 30 from the window unit 1. For example, in some instances, depending on the particular construction or design of the window unit 1, the spacer assembly 40 may be needed in order to space the glazing layer 30 from the window unit 1, for example, maintaining window operability when applied to the sash. In some cases, and particularly but not limited to some commercial storefront applications, the spacer assembly 40 may be adhered or secured to the window pane(s) 5 itself. For instance, some windows may not have a sash 4 or frame 2 that can be easily used or that can be used to attach the glazing layer(s) 30 to. In such a case, the spacer assembly 40 may be used to create a flat surface upon which the glazing layer(s) 30 can be attached, or it can create a spaced relation between the window pane 5 and the glazing layer 30 for the insulated airspace 12.

In some cases, the spacer assembly 40 or spacer bars 42, 44, 46 may be substantially rigid or rigid and, as an example, can be constructed of polyvinyl chloride (PVC) trim material. For example, the various spacer bars 42, 44, 46 of at least one exemplary embodiment may include ⅝ inch×⅝ inch PVC trim material that can be cut-to-measure and easily applied to the window unit 1. Of course, other sizes, dimensions and materials are contemplated within the full spirit and scope of the present invention.

For instance, in at least one embodiment, the spacer assembly 40 may be adhered to the window unit 1 via a peel-and-stick adhesive tape 20. The adhesive tape may be already secured to one side of the spacer assembly 40, or it may be separate such that the user or installer may be able to adhere to the tape or attachment assembly 20 to the spacer assembly 40 and the window unit 1. Accordingly, in such an embodiment, the attachment assembly 20 used to secure the spacer assembly to the window unit may include a peel-and-stick double-sided adhesive tape that can be secured around the perimeter of the spacer assembly 40 between the spacer assembly 40 and the window unit 1 (e.g., on the sash 4 or window pane 5) to provide an air-tight and/or weather-tight seal.

An additional attachment assembly 20, such as additional peel-and-stick double-sided tape may be adhered or secured to the other or outside surface of the spacer assembly 40 in order to allow the glazing layer(s) 30 to be secured or adhered thereto. Accordingly, the spacer assembly 40 may be secured between the window unit 1 and the glazing layer(s) 30 to create the insulated airspace 12, as shown in FIGS. 5 and 6, for example.

Referring to FIG. 5, the spacer assembly 40 of at least one embodiment includes a top spacer bar 42, a bottom spacer bar 44 and two side spacer bars 46. For instance, in one embodiment, the top spacer bar 42 may include opposite lateral ends 43 that extend to or align with outer lateral edges 47 of the side spacer bars 46. In this regard, there are no vertical joints between the top spacer bar 42 and the side spacer bars 46—only the two horizontal joints. This offers structural rigidity in the top spacer bar 42, which can be used as a structural load bearing support in some implementations. Still referring to FIG. 5, the bottom spacer bar 44 of at least one embodiment may fit between inner side edges 45 of the side spacer bars 46 such that there are no vertical joints between the bottom spacer bar 44 and the side spacer bars 46—only the vertical joints.

Figure 6:
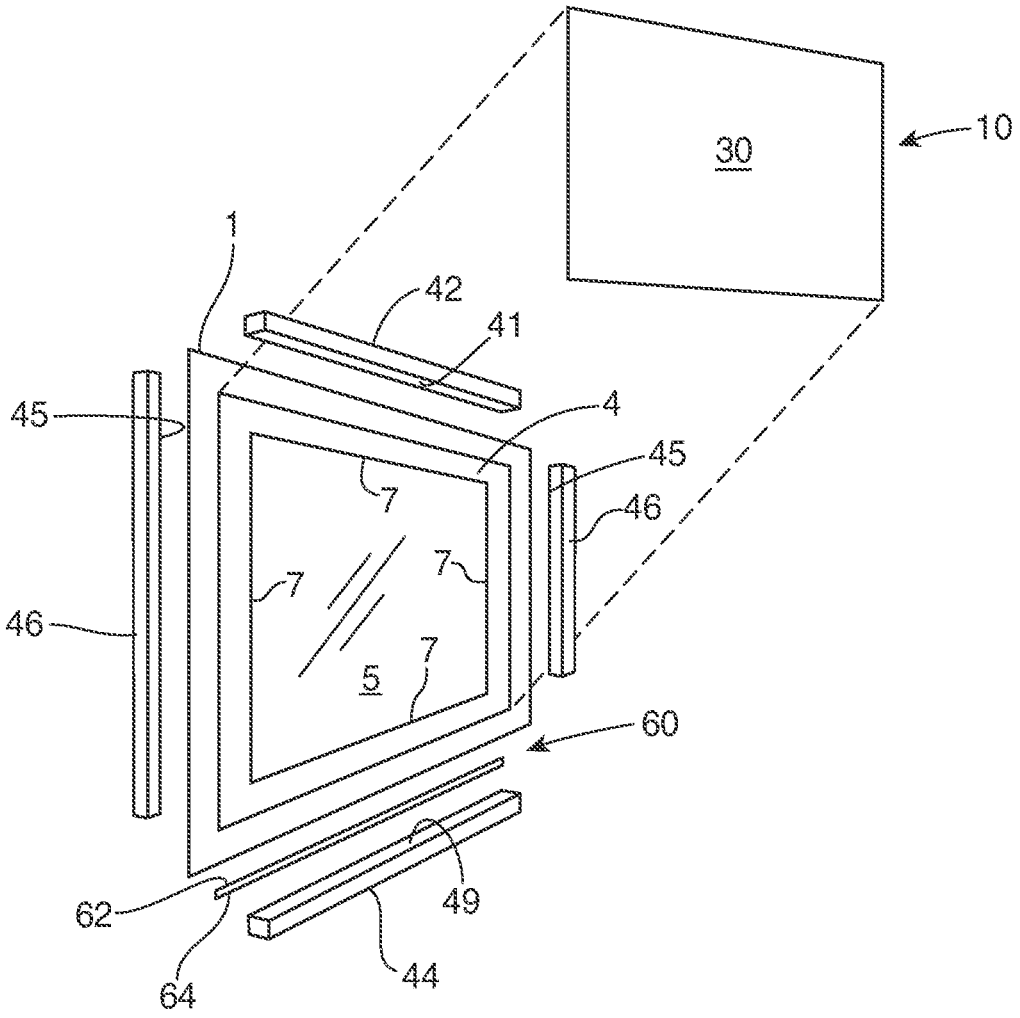
FIG. 6 is a perspective, exploded view of the glazing assembly as disclosed in accordance with at least one embodiment herein.

Furthermore, in at least one embodiment, the inner edge (s) of the spacer assembly 40, represented as 41, 45, and 49 in FIG. 5 may substantially align with or be adjacent the inner edge of the sash 4, represented as 7 in FIG. 6.

Other installation techniques and alignment of the spacer bars or spacer assembly 40 may be implemented in accordance with the various embodiments described herein.

Figure 7:
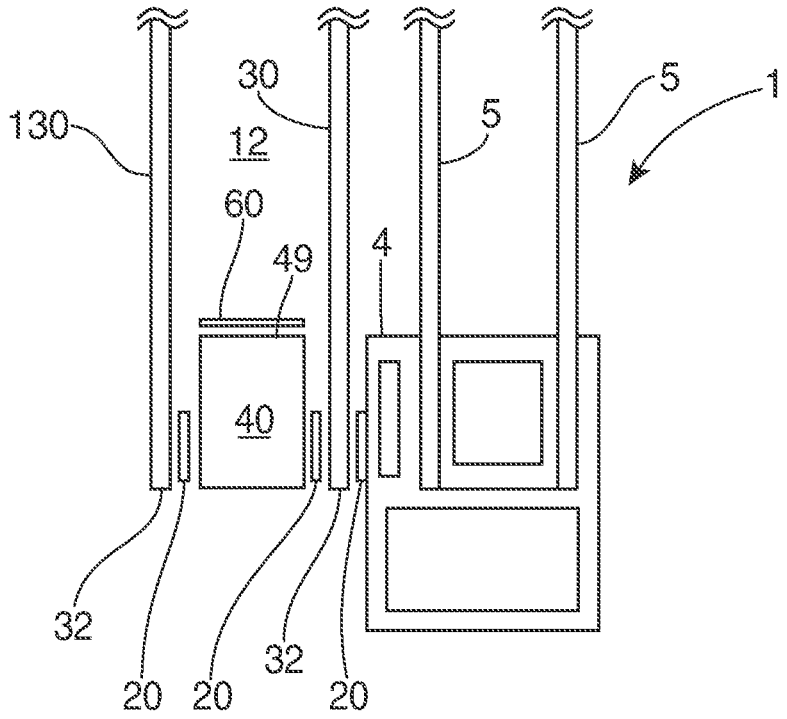
FIG. 7 is a side cut-away view of a window unit with the glazing assembly of one embodiment installed on one side thereof.

With reference now to the cut-away or sectional view of FIG. 7, an exemplary installation of the glazing assembly 10 on one side of a window unit 1 using a spacer assembly 40 is shown. In this example, window unit 1 includes a double pane window, such that the window unit 1 already includes two (2) panes 5. In any event, the spacer assembly 40 is shown as being attached to the inner glazing layer 30 via an attachment assembly 20, such as a peel-and-stick double-sided adhesive tape. Similarly, the outer glazing layer 130 is shown as being attached to the spacer assembly 40 via an additional attachment assembly 20, which again, may be a peel-and-stick double-sided adhesive tape. Other attachment assemblies structured to facilitate the practice of the present invention in the intended manner are contemplated. Either way, the spacer assembly 40 facilitates in the creation of an insulated airspace 12, in this example, between an inner glazing layer 30 and an outer glazing layer 130, with a weather-resistant perimeter seal via the attachment assemblies 20. It should be noted, however, that the attachment assembly 20 may be secured directly to the window unit 1, such as at the sash 4, such that the inner glazing layer 30 shown in FIG. 5 may not be included. In such a case, the spacer assembly 40 facilitates in the creation of an insulated airspace 12 between the window pane 5 and the outer glazing layer 130

In some embodiments, the spacer assembly 40 and the glazing layer(s) 30 may be constructed of materials with similar coefficients of thermal expansion. For example, in some embodiments the spacer assembly 40 may be constructed of a PVC type of material and the glazing layer(s) 30 may be constructed of an acrylic, plastic or glass. In some implementations, the coefficients of thermal expansion for the material selected for the spacer assembly 40 may be substantially the same as the coefficient of thermal expansion for the material selected for the glazing layer(s) 30, and in particular, the coefficients of thermal expansion may be between 1 and 2 times one another for the different materials or for the spacer assembly 40 and the glazing layer(s) 30.

It should also be noted that the glazing layer(s) 30 of some embodiments may be tinted, for example, it may be coated with a window film comprising a tint that is adapted to restrict the passage of sunlight or UV rays there through. Some embodiments of the glazing layer(s) 30 may also be constructed of a hurricane wind or impact resistant material. In this manner, the assembly 10 of the present invention may also serve to provide thermal loss and gain resistance via the tint or window film and/or impact resistance via the material selected for the glazing layer 30. Further embodiments may also include a desiccant or other drying agent disposed on the inside of the airspace 12 or otherwise exposed to the inside of the airspace 12 in order to control moisture or condensation with the airspace 12. For example, as shown in FIGS. 6 and 7, in at least one embodiment, a desiccant tape 60 or other drying agent may be adhered to the inside-facing surface(s) 41, 45, 49 of the spacer assembly 40 such that a desiccant or drying agent surface 62 of the tape 60 faces inward toward the airspace 12, and the adhesive surface 64 secures to the spacer assembly 40. Although, the desiccant tape 60 is shown as being attached to the lower or bottom bar 44, the desiccant tape 60 may be adhered or attached to any one or more of the bars 42, 44, 46 of the spacer assembly 60. It should also be noted that the desiccant tape 60 may be adhered to the window unit 1 (such as the sash 2, frame 4, or window pane 5) or to the glazing panel 30, so long as the desiccant surface 62 is exposed to the airspace 12 created by the assembly 10 in order to control moisture, condensation, etc. therein. Other embodiments may use other condensation or moisture control substances or devices, and as such, the present invention is not limited to use of desiccant tape. For example, other types of tape, packets, dry packs, silica gel devices/packs, etc. can be used.

Figure 13:
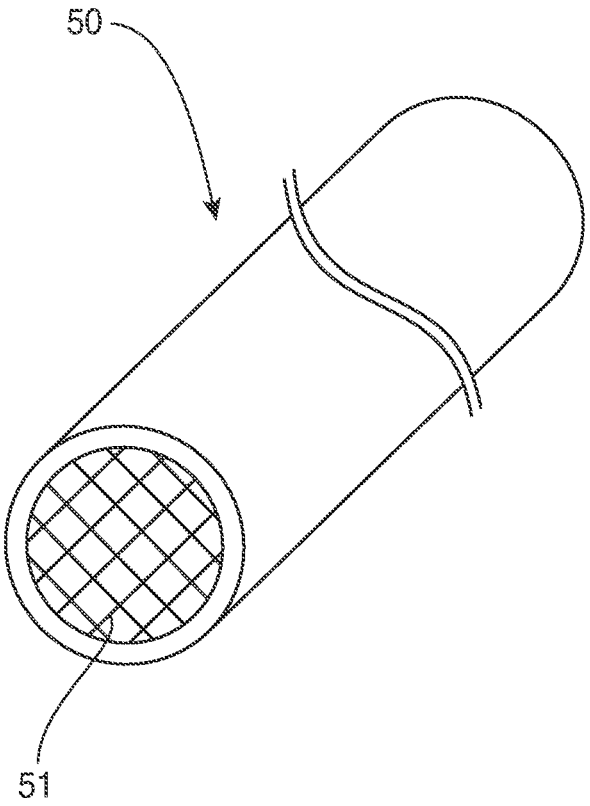
FIG. 13 is a perspective end view of a desiccant-filled conduit as disclosed in accordance with at least one embodiment of the present invention.

Other embodiments may include one or more modular ventilated desiccant (or other drying agent) filled conduits or tubes 50 that may be adhered or attached to the inside face of the sash or spacer bar(s), for example, for condensation control. In particular, with reference to FIGS. 13 and 14, the conduit(s) 50 may include ventilation sections 51, for instance, at the ends or along the length thereof, for allowing the desiccant substance or other drying agent disposed therein to be exposed to surrounding air or environment. In this case, the conduit(s) 50 may be disposed within the insulated airspace(s) 12, for example, by being secured to a portion of the spacer assembly 40, the inside-facing surface of one or more of the layers 30, etc. In yet another embodiment, a desiccant substance (or other drying agent) may be embedded directly in the spacer bar(s) or spacer assembly 40, for instance, in drilled or other made holes or channels. The holes or channels may include a perforated or ventilated cover in order to allow ventilation between the desiccant substance and the insulating airspace 12.

It should also be noted that the glazing layer(s) 30 and/or spacer assemblies 40 may be constructed in virtually any shape and size, including curves, and thus should not be deemed limited to the square or rectangular shapes shown in the Figures. For example, a curved spacer assembly 40 and/or glazing layer 30 can be used to create airspaces 12 for barrel vaulted skylights, greenhouses, light transmitting panels, and windows with curves and other unique shapes and sizes. For instance, the spacer bar(s) may be bent along the thickness, along with the attachment assembly or adhesive strips and the acrylic (or other) glazing layer(s) to match the curves or other dimensions of virtually any shape and size window, such as skylights, greenhouses, light transmitting panels, etc.

Figure 8:
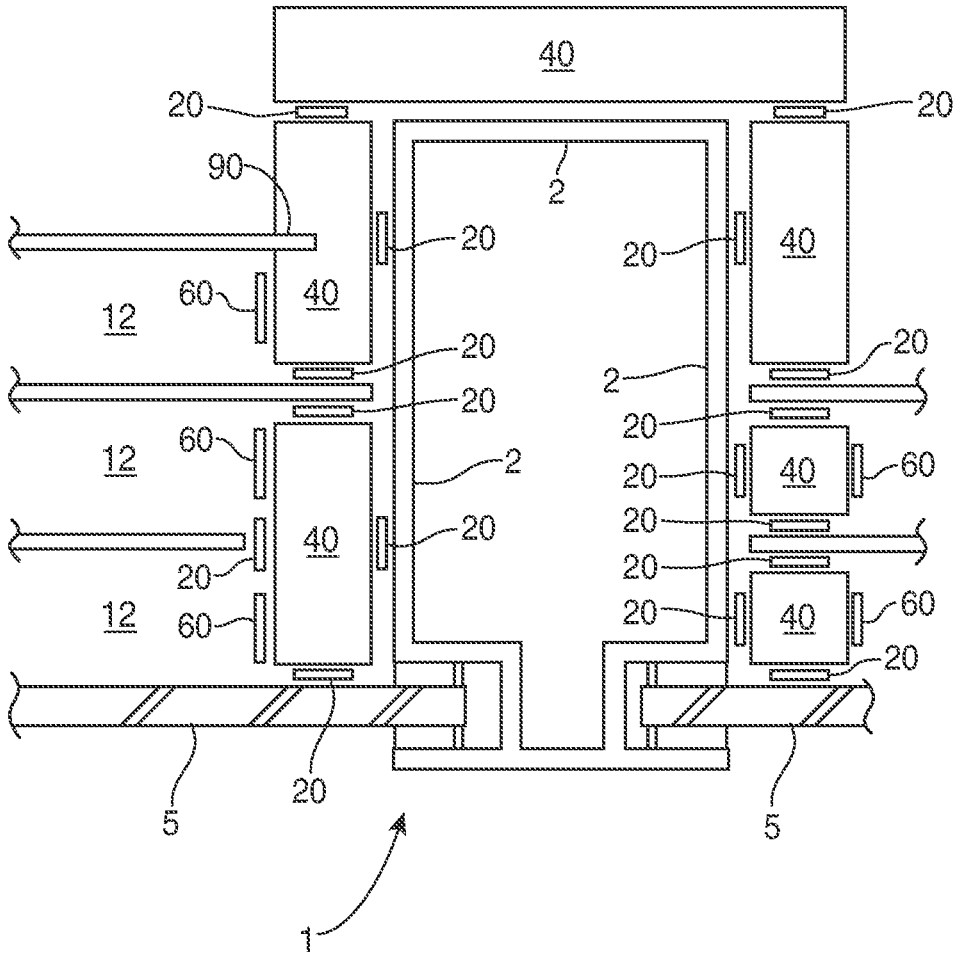
FIG. 8 is a plan view of a storefront window with the glazing assembly of at least one embodiment installed thereon and illustrated in a partially exploded fashion.

Referring now to FIG. 8, a plan and partially exploded view of the glazing assembly 10 is shown installed on an aluminum frame 2 of a commercial storefront, as an example, with a single layer glass pane 5 towards the exterior. Insulating airspaces 12 are created by applying peel-and-stick attachment tape 20 to the frame 2 and/or a plurality of spacer bars or spacer assemblies 40. One or more glazing layers 30 can be applied or secured to the spacer assemblies 40, for example, via attachment tape 20, fitted channels 90, etc. Furthermore, as provided herein, desiccant tape 60 or other like drying agents tubes, conduits or channels may be exposed to the inside of the airspaces 12.

With reference now to FIGS. 9 through 12, the window glazing assembly includes a multi-glazed window assembly, referenced as 80, which may be used for new construction, replacement windows, etc. In particular, the assembly 80 of at least one embodiment includes an inner and outer glazing layers 130, 230, and in some embodiments, one or more intermediate glazing layers 330. Specifically, the inner glazing layer 130 may be facing, exposed to, or disposed on the inside of the building, structure or home, whereas the outer glazing layer 230 may be facing, exposed to, or disposed on the outside of the building structure or home.

Figure 9:
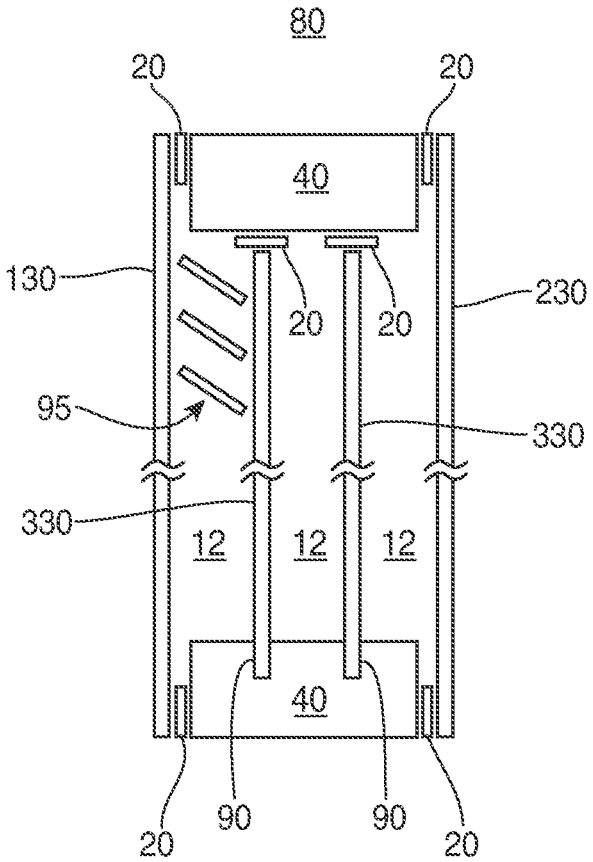
FIG. 9 is a side, sectional and at least partially exploded view of the multi-glazed window assembly as disclosed in accordance with at least one embodiment of the present invention.

Specifically, the embodiment illustrated in FIG. 9 includes an inner glazing layer 130, an outer glazing layer 230 and two intermediate glazing layers 330. The inner and outer glazing layers 130 and 230 are secured to a spacer assembly 40 via an attachment assembly 20, such as, for example, peel-and-stick double-sided adhesive tape, although other attachment assemblies or mechanisms may be used. As before, the tape may be secured around the outer edges of the glazing layers 130, 230 to provide a continuous edge or perimeter seal.

The intermediate glazing layer(s) 330 may be secured to the same spacer assembly 40. For example, in the embodiment illustrated in FIG. 9, the intermediate glazing layers 330 are secured at one end (e.g., the bottom end) to the corresponding (e.g. bottom) bar of the spacer assembly 40 via cooperative slots, channels or kerfs 90 cut into the surface of the spacer bar or spacer assembly 40. At the other end (e.g., top end), the intermediate glazing layers 330 are secured to the spacer assembly 40 via double-sided tape. Other attachment mechanisms, devices, or means are contemplated.

Also, as shown in FIG. 9, a shade assembly, generally referenced as 95 is shown as being disposed between two of the glazing layers and within the insulting airspace 12 created thereby. In the illustration, the shading assembly 95 includes a plurality of spaced louvers that can be used to control an amount of light passing through the window assembly 80. The shade assembly may be fixed or movable and may be secured to the glazing layers and/or to the spacer assembly 40.

Figure 10:
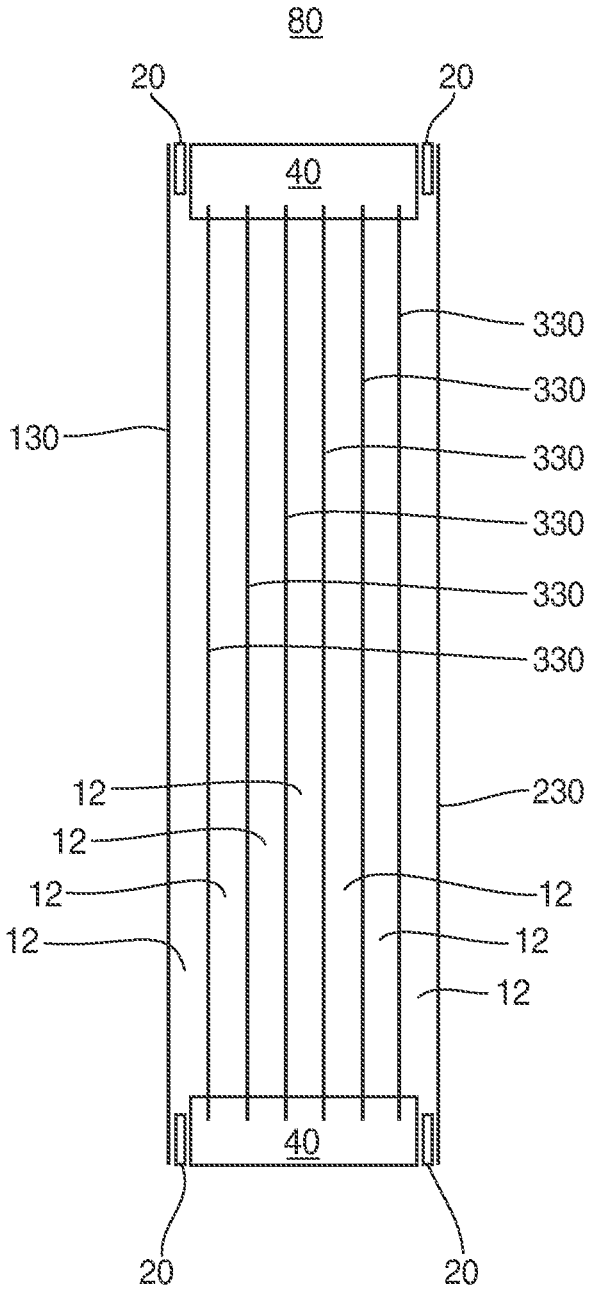
FIG. 10 is a side, sectional and at least partially exploded view of the multi-glazed window assembly as disclosed in accordance with another embodiment of the present invention.

FIG. 10 illustrates a further embodiment of the multi-glazed window assembly 80. In particular, inner and outer glazing layers 130, 230 are adhered to a spacer assembly 40 via an attachment assembly 20, such as double-sided attachment or adhesive tape around its perimeter. A plurality of intermediate glazing layers 330 are secured in slots or channels along the inside of the spacer bars of the spacer assembly 40 to create seven (7) separate insulating airspaces 12. This can create a total thermal resistance or R-value of R-14 or higher. It should also be noted that, the inner and outer glazing layers 130, 230 of this installation may act as structural diaphragms between the spacer assembly 40 to create a stress-skin panel capable of resisting structural loads.

The load-bearing capacity is aided by the additional structural diaphragm created by the intermediate glazing layers 330 through their attachment to the spacer assembly 40, which, in some installations, can act as both the sash and frame for the window unit. These multi-layered clear-skinned structural diaphragms may avoid the use of headers and potentially carry floor or roof loads without added structure. The diaphragms further add to structural lateral resistance as a sheer panel when connected to other structural elements.

Figure 11:
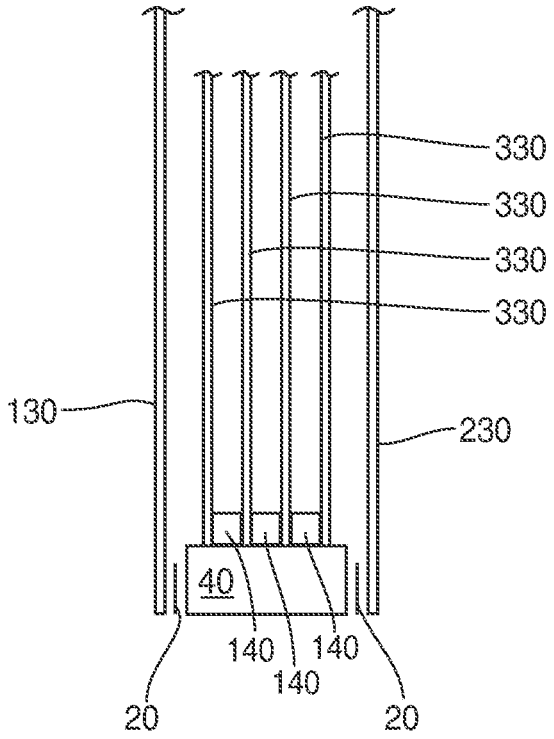
FIG. 11 is a side, sectional, cut-away and at least partially exploded view of the multi-glazed window assembly as disclosed in accordance with another embodiment of the present invention.

FIG. 11 illustrates another embodiment with intermediate spacers 140 secured or disposed between some or all of the intermediate glazing layers 330 in order to facilitate connection or attachment of the intermediate glazing layer 330. For instance, the intermediate spacers 140 may be secured to the inner face of the spacer assembly 40, providing one or more attachment surfaces for the intermediate glazing layers 330 to attach, as shown. The intermediate spacers 140 may be secured or attached to the spacer assembly 40 via an attachment assembly 20, such as double-sided tape or other attachment methods or devices. Similarly, the intermediate glazing layers 330 may be secured to the intermediate spacers 140 via an attachment assembly 20, such as double-sided tape or other methods or devices.

Figure 12:
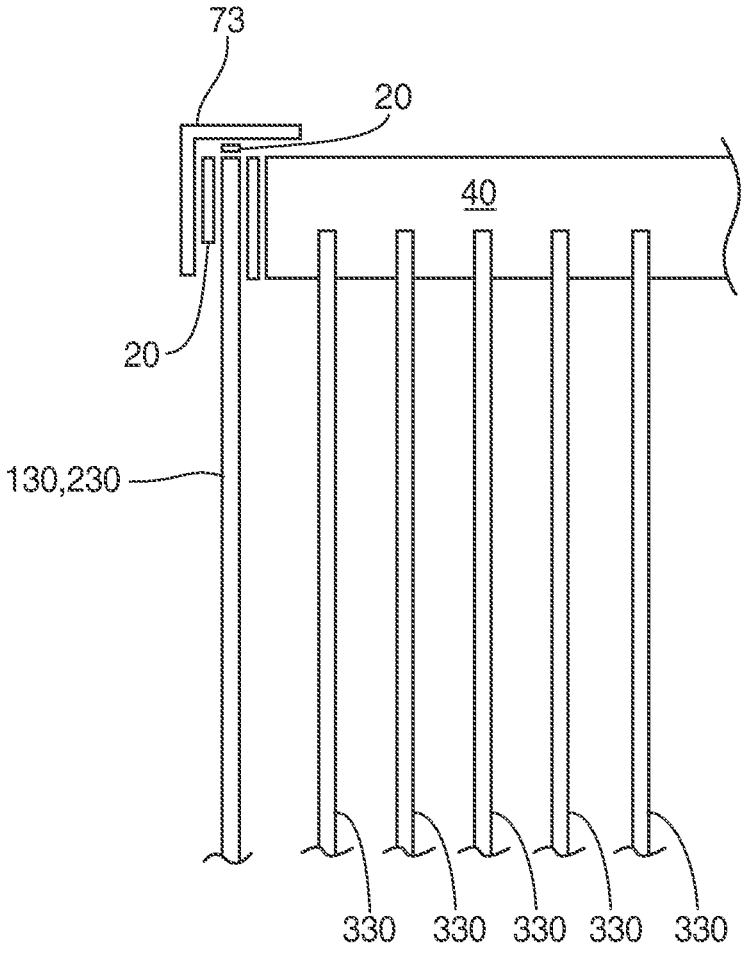
FIG. 12 is a side, sectional, cut-away and at least partially exploded view of the multi-glazed window assembly as disclosed in accordance with yet another embodiment of the present invention.

FIG. 12 illustrates corner edge treatments or covers 73 (e.g., angle section trim) which may be disposed over one or more of the outer exposed corners of the glazing layer(s) 130, 230 in order to create a finished appearance and, in some cases, additional weather protection, particularly for externally installed assemblies 10.

Referring again to FIG. 14, at least one embodiment may further include a conduit 75, such as a ventilation tube or conduit, that passes through one or more of the plurality of glazing layers and provide airflow there through. Particularly, in one embodiment, the conduit 75 or ventilation tube may pass through each of the glazing layers 130, 230, 330 in order to provide ventilation and/or airflow there through, such as, from outside of the building, through the assembly, and into the inside of the building.

Figure 14:
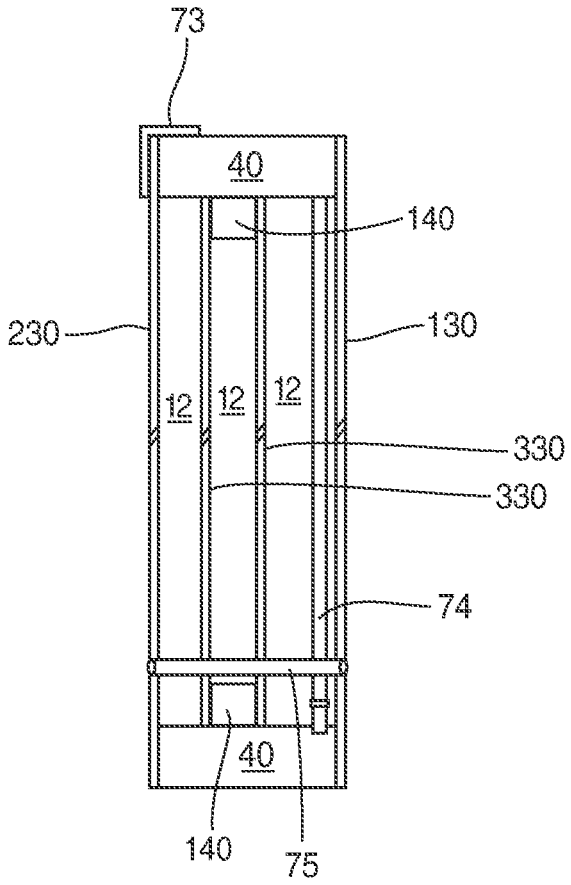
FIG. 14 is a side, sectional and at least partially exploded view of the multi-glazed window assembly as disclosed in accordance with another embodiment of the present invention.

Still referring to FIG. 14, at least one embodiment may further include a heat collection and transfer conduit 74, such as a radiant heat tube, that is disposed within at least one of the airspaces 12. In the embodiment shown, the heat collection and transfer conduit 74 is attached to the spacer assembly 40 at opposite ends thereof, although other attachments or securement of the conduit 74 is contemplated. In any event, the conduit 74 of at least one embodiment may include a heat transfer fluid or other like substance disposed therein for providing radiant heat collection and transfer.

Figure 15:
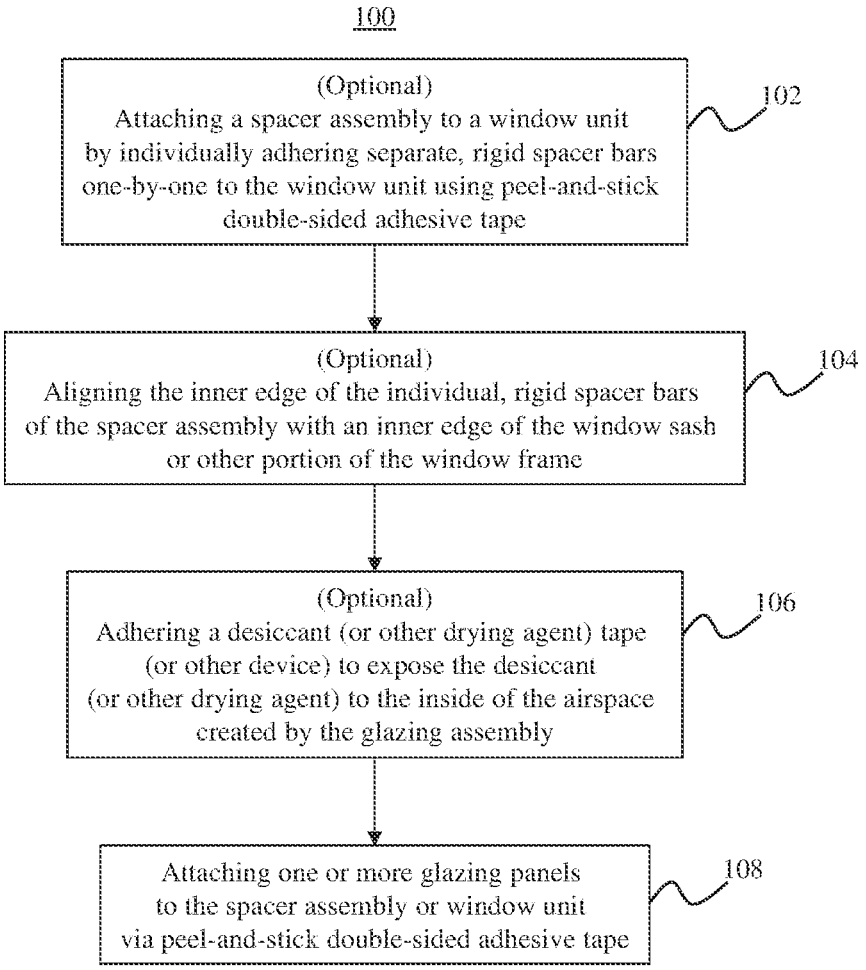
FIG. 15 is a high level flow chart illustrating the method as disclosed in accordance with at least one embodiment of the present invention.

With reference now to FIG. 15, the present invention further comprises a method of installing a glazing assembly 10 to an already-installed window unit or to a new construction window unit. The method, generally referenced as 100, includes attaching a spacer assembly to a window unit 102. As provided above, the spacer assembly 40 of at least one embodiment may include a plurality of separate, rigid spacer bars 42, 44, 46. In one embodiment of the method 100, the individual bars 42, 44, 46 may be adhered to the window unit, one-by-one, to create the final spacer assembly 40. Specifically, rather than assembling a spacer assembly first, and the attaching that assembly to the window unit, the spacer bars 42, 44, 46 may be individually attached to the window unit (e.g., to the sash 4, the window pane 5 or other portions of the frame 2).

As above, in one embodiment, the attachment assembly includes a peel-and-stick double-sided adhesive tape. In this manner, the tape or attachment assembly 20 may be adhered to the spacer assembly 40 or the individual bars thereof, which can then be adhered to the window unit 1. Alternatively, the attachment assembly 20 may first be adhered to the window unit 1, and then the spacer assembly 40, and in particular, the individual bars, may be adhered thereto. Either way, the individual or one-by-one placement or installation of the bars 42, 44, 46 allows the spacer assembly 40 to obtain a tight, secure and weather-resistant seal around its entire perimeter.

Furthermore, as shown at 104, the method 100 may also include aligning the inner edge of the spacer assembly 40, and in particular, the individual bars 42, 44, 46 thereof, to an inner edge of the window frame 2, such as an inner edge of a window sash 2.

Some embodiments also include adhering or installing a desiccant tape or other moisture control device, as shown at 106. For example, the moisture control device or desiccant tape may be adhered to an inside edge of the spacer assembly 40, to the window unit 1, itself, or to any other location, so long as the desiccant portion or other dry material portion is exposed to the inner airspace created by the glazing assembly 10 of the present invention.

Accordingly, as shown at 108, the method 100 further includes attaching the one or more glazing layers 30 to the window unit 1 or to the spacer assembly 40 (if used). The glazing panel 30 may be adhered to the window unit 1 or spacer assembly 40 via peel-and-stick tape or other attachment assembly 20 that will create an airtight and weather-resistant seal, preferably around the perimeter of the glazing layer 30.

Furthermore, it should also be noted that some embodiments of the present invention, as shown in FIG. 10, may include additional or intermediate glazing layers 330, for example, between the window pane 5 and the glazing panel 30 in retrofit situations, or between inner and outer glazing layers 30 in the case of new construction and replacement windows. In this manner, the present invention may create a number of different, individual and spaced airspaces via intermediate spaced glazing layers installed on the inside and/or outside of the window unit 1 or between inner and outer glazing layers 30. This may be accomplished in a number of different ways. For example, in one embodiment, the spacer bars 42, 44, 46 may be thicker (e.g., in the range of 1 inch to 7.25 inches) wide with one or more glazing layers 30 disposed along the width thereof creating a multi-layered glazing assembly with an extremely high thermal resistance and energy efficiency. Particularly, one or more of the intermediate glazing layers can be adhered around its perimeter to the inner face of an intermediate spacer bar 140 (e.g., via glue, tape, etc.) In another embodiment, the spacer bar(s) may include routed slots, channels or kerfs on the inner face thereof for receiving the outer perimeter edge of the intermediate glazing layer(s). In this manner, a plurality of glazing layers may be installed or attached to a spacer assembly creating a plurality of insulated airspaces via a single glazing assembly. In some applications, each ½ inch of insulating airspace, for example, as created by the intermediate glazing layer(s) and/or outer glazing layer(s), forms an R-2 (or more) thermal resistance. For example, an application with three (3) insulating airspaces, created by using three glazing layers, forms an R-6 (or more) thermal resistance.

Moreover, in some embodiments, tinting or other window film or overlay may be used to control or optimize energy or heat loss/gain depending on various factors, including, but not limited to the particular climate zone in which the window is located in the structure, the compass orientation of the window (e.g., does it face north, south, east or west), the exterior shading condition proximate the window, etc. Particularly, tinted glazing panels may be positioned or located toward the exterior of the window unit in a cooling degree-day-dominated climate, in order to maximize heat rejection. Whereas, tinted glazing layers may be positioned or located toward the interior of the window unit in heating degree-day-dominated climates, thereby balancing desirable winter heat gain with summer heat rejection. This will cause light to be absorbed and the reradiated as heat from the tinted glazing panels work in favor of the dominate season.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

Now that the invention has been described,

What is claimed is:

1. A multi-glazed window assembly for new construction or replacement windows, said multi-glazed window assembly comprising:

a plurality of glazing layers comprising an inner glazing layer, an outer glazing layer and at least one intermediate glazing layer, said plurality of glazing layers being disposed in a spaced relation to one another to define a plurality of insulating airspaces, and a rigid spacer assembly disposed between said inner glazing layer and said outer glazing layer, wherein said rigid spacer assembly comprises at least one rigid spacer bar connected at one end to an inward surface of said inner glazing layer and at another end to an inward surface of said outer glazing layer, said rigid spacer assembly further comprising at least one rigid intermediate spacer bar attached to said at least one spacer bar and said at least one intermediate glazing layer, wherein said at least one rigid intermediate spacer bar and said at least one rigid spacer bar are separate pieces, wherein said rigid spacer assembly and said plurality of glazing layers transfer structural roof loads of a building, within which said multi-glazed window assembly is installed, and wherein said multi-glazed window assembly is installed within the building without a window header.

2. The multi-glazed window assembly as recited in claim 1 where said plurality of glazing layers comprise at least one curved surface, and wherein said rigid spacer assembly comprises at least one spacer bar comprising an at least partially curved surface configuration corresponding to said at least one curved surface of said plurality of glazing layers.

3. The multi-glazed window assembly as recited in claim 1 further comprising a heat transfer conduit disposed within at least one of said plurality of insulating airspaces; said heat transfer conduit comprising a heat transfer fluid disposed therein, providing radiant heat collection and transfer.

4. A multi-glazed window assembly, said multi-glazed window assembly comprising:

a plurality of glazing layers comprising an inner glazing layer, an outer glazing layer and at least one intermediate glazing layer, said plurality of glazing layers being disposed in a spaced relation to one another to define a plurality of insulating airspaces, a spacer assembly disposed between said inner glazing layer and said outer glazing layer, wherein said spacer assembly comprises at least one spacer bar connected at one end to an inward surface of said inner glazing layer and at another end to an inward surface of said outer glazing layer, said spacer assembly further comprising at least one intermediate spacer bar attached to said at least one spacer bar and said at least one intermediate glazing layer, and at least one ventilation tube passing through said outer glazing layer, through said at least one intermediate glazing layer, and through said inner glazing layer, wherein said ventilation tube is structured to provide a flow of air from an outward surface of said outer glazing layer, through said at least one intermediate glazing layer, and to an opposite, outward surface of said inner glazing layer.

5. The multi-glazed window assembly as recited in claim 4 wherein said at least one intermediate spacer bar and said at least one spacer bar are separate pieces.

6. A multi-glazed window assembly for new construction or replacement windows, said multi-glazed window assembly comprising:

a plurality of glazing layers comprising an inner glazing layer, an outer glazing layer and at least one intermediate glazing layer, said plurality of glazing layers being disposed in a spaced relation to one another to define a plurality of insulating airspaces, a rigid spacer assembly disposed between said inner glazing layer and said outer glazing layer, wherein said rigid spacer assembly comprises at least one rigid spacer bar connected at one end to an inward surface of said inner glazing layer and at another end to an inward surface of said outer glazing layer, said rigid spacer assembly further comprising at least one rigid intermediate spacer bar attached to said at least one spacer bar and said at least one intermediate glazing layer, wherein said at least one rigid intermediate spacer bar and said at least one rigid spacer bar are separate pieces, and at least one ventilation tube passing through said outer glazing layer, through said at least one intermediate glazing layer, and through said inner glazing layer, wherein said ventilation tube is structured to provide a flow of air from an outward surface of said outer glazing layer, through said at least one intermediate glazing layer, and to an opposite, outward surface of said inner glazing layer.

* * * * *